US012798846B2

(12) United States Patent
Lee et al.

(10) Patent No.: US 12,798,846 B2
(45) Date of Patent: Nov. 17, 2026

(54) CONTAINER LID HAVING OPENING IDENTIFICATION FUNCTION

(71) Applicants: MPLB CO., LTD., Cheonan-si (KR); Dong Jun Lee, Pyeongtaek-si (KR); Eun Jae Lee, Pyeongtaek-si (KR)

(72) Inventors: Dong Jun Lee, Pyeongtaek-si (KR); Eun Jae Lee, Pyeongtaek-si (KR)

(73) Assignees: MPLB CO., LTD., Cheonan-si (KR); Dong Jun Lee, Pyeongtaek-si (KR); Eun Jae Lee, Pyeongtaek-si (KR)

( * ) Notice: Subject to any disclaimer, the term of this patent is extended or adjusted under 35 U.S.C. 154(b) by 0 days.

(21) Appl. No.: 19/119,165

(22) PCT Filed: Oct. 24, 2022

(86) PCT No.: PCT/KR2022/016277
§ 371 (c)(1),
(2) Date: Apr. 8, 2025

(87) PCT Pub. No.: WO2024/090592
PCT Pub. Date: May 2, 2024

(65) Prior Publication Data

US 2026/0200648 A1 Jul. 16, 2026

(51) Int. Cl.
*B65D 55/02* (2006.01)
*B65D 43/16* (2006.01)

(52) U.S. Cl.
CPC ..... *B65D 55/026* (2013.01); *B65D 43/169* (2013.01)

(58) Field of Classification Search
CPC ..... B65D 41/3428; B65D 2401/15; B65D 47/0838; B65D 55/16; B65D 2401/30;
(Continued)

(56) References Cited

U.S. PATENT DOCUMENTS 3,776,406 A * 12/1973 Milbourne, Sr. .... B65D 50/066 215/321
3,902,621 A * 9/1975 Hidding ..... B65D 41/3409 215/254
(Continued)

FOREIGN PATENT DOCUMENTS

JP 2014213895 A 11/2014
KR 19990083724 A 12/1999
(Continued)

OTHER PUBLICATIONS

PCT International Search Report for International Application No. PCT/KR2022/016277, mailed Jul. 12, 2023, 6pp.
(Continued)

*Primary Examiner* — Prince Pal
(74) *Attorney, Agent, or Firm* — The Roy Gross Law Firm, LLC; Roy D. Gross

(57) ABSTRACT

The present invention relates to a container lid having an opening identification function and, more specifically, to a container lid having an opening identification function which enables easy identification of whether an initial opening of the container has occurred. In the present invention, a fracture member for connecting a base member and a cover member is cut when the cover member is first opened and, in this case, since a portion that configures the fracture member is unfolded and expanded in upward and downward directions, plastically deformed, and then cut, a user can easily recognize cutting and deformation of the fracture member so as to easily identify the initial opening of the cover member.

6 Claims, 4 Drawing Sheets

(58) Field of Classification Search
CPC ..... B65D 2401/35; B65D 41/3447; B65D 50/045; B65D 47/0804; B65D 55/024; B65D 2401/20
USPC ..... 215/252, 258, 256, 306, 253, 216; 220/212.5
See application file for complete search history.

(56) References Cited

U.S. PATENT DOCUMENTS 4,062,466 A * 12/1977 Conti ..... B65D 41/3409 215/252
4,241,842 A * 12/1980 Toeppen ..... B65D 41/3447 215/252
4,278,180 A * 7/1981 Willis ..... B65D 41/3447 215/252
4,460,100 A * 7/1984 Libit ..... B65D 47/0895 215/256
4,471,878 A * 9/1984 Davis ..... B65D 41/0421 215/258
4,505,401 A * 3/1985 Berglund ..... B65D 41/3452 215/252
4,529,096 A * 7/1985 Chartier ..... B65D 41/3452 215/250
4,557,393 A * 12/1985 Boik ..... B65D 41/48 215/253
4,573,601 A * 3/1986 Berglund ..... B65D 41/3452 215/258
4,597,500 A * 7/1986 Stubbs ..... B65D 41/48 215/256
4,667,836 A * 5/1987 McLaren ..... B65D 41/3414 215/258
4,844,272 A * 7/1989 Dutt ..... B65D 41/3495 215/232
5,033,632 A * 7/1991 Mattia ..... B65D 41/3452 215/258
5,056,675 A * 10/1991 Julian ..... B65D 55/16 215/252
5,201,440 A * 4/1993 Gross ..... B65D 47/0861 222/541.9
5,215,204 A * 6/1993 Beck ..... B65D 55/16 215/258
5,246,125 A * 9/1993 Julian ..... B65D 41/3447 215/252
5,373,954 A * 12/1994 Julian ..... B65D 41/3409 215/256
5,484,071 A * 1/1996 Zumbuhl ..... B65D 41/3447 215/256
5,570,798 A * 11/1996 Hayashida ..... B65D 41/3428 215/252
5,642,825 A * 7/1997 Wohlgemuth ..... B65D 41/47 215/901
5,853,095 A * 12/1998 Marshall ..... B65D 41/3428 215/901
5,875,908 A * 3/1999 Witt ..... B65D 41/325 215/256
6,000,568 A * 12/1999 Verter ..... B65D 41/3404 215/230
6,116,443 A * 9/2000 Parrinello ..... B65D 41/3428 215/252
6,299,005 B1 * 10/2001 Higgins ..... B65D 41/48 215/253
6,347,716 B1 * 2/2002 Nofer ..... B65D 47/0804 222/541.5
6,474,491 B1 * 11/2002 Benoit-Gonin .... B65D 41/3428 220/263
6,631,820 B2 * 10/2003 Harrold ..... B65D 47/0809 220/837
7,134,567 B2 * 11/2006 Luburic ..... B65D 43/0256 220/276
7,156,247 B2 * 1/2007 Laburu ..... B65D 47/0809 222/541.6
8,033,419 B1 * 10/2011 Szekely ..... B65D 41/3428 220/717
8,439,212 B2 * 5/2013 Clodfelter ..... B65D 47/0857 215/253
8,485,373 B2 * 7/2013 Antier ..... B65D 47/0857 215/253
8,794,460 B2 * 8/2014 Druitt ..... B65D 50/061 220/345.2
8,939,302 B2 * 1/2015 Last ..... B65D 41/34 222/541.6
11,713,170 B2 * 8/2023 Mélan-Moutet ... B65D 41/3447 215/252
11,738,911 B2 * 8/2023 Falzoni ..... B65D 41/3447 215/252
11,753,215 B2 * 9/2023 Oomori ..... B65D 41/3428 215/252
11,807,436 B2 * 11/2023 Lamoureux ..... B65D 55/16
11,975,889 B2 * 5/2024 Kick ..... B65D 1/0223
12,371,231 B2 * 7/2025 Gauthey ..... B65D 5/746
12,454,392 B2 * 10/2025 Dubach ..... B65D 41/325
12,570,448 B2 * 3/2026 Naumann ..... B29C 45/26
2003/0217987 A1 * 11/2003 Pehr ..... B65D 41/3447 215/252
2004/0011757 A1 * 1/2004 Shinozaki ..... B65D 41/3452 215/252
2004/0045926 A1 * 3/2004 Williamson ..... B65D 41/0421 215/252
2004/0150221 A1 * 8/2004 Brown ..... B65D 55/06 215/253
2004/0188374 A1 * 9/2004 Ochoa Laburu ..... B65D 41/34 215/254
2005/0023238 A1 * 2/2005 Wong ..... B65D 55/16 220/291
2005/0127023 A1 * 6/2005 Mockli ..... B65D 41/485 215/256
2006/0124575 A1 * 6/2006 Mavin ..... B65D 5/746 215/258
2006/0249474 A1 * 11/2006 Sawyer ..... B65D 47/0804 215/256
2007/0062944 A1 * 3/2007 Hsieh ..... B65D 51/242 220/780
2009/0057260 A1 * 3/2009 Mohindra ..... B65D 55/02 215/252
2009/0101644 A1 * 4/2009 Maiwald ..... B65D 47/122 220/254.1
2010/0326948 A1 * 12/2010 Campbell ..... B65D 41/34 215/258
2011/0000871 A1 * 1/2011 Bernard ..... B65D 55/16 215/235
2011/0114593 A1 * 5/2011 Ishii ..... B65D 41/325 215/253
2012/0305564 A1 * 12/2012 Hayashi ..... B65D 41/3428 220/288
2013/0001185 A1 * 1/2013 Antier ..... B65D 55/16 215/253
2014/0197169 A1 * 7/2014 Carlile ..... B65D 47/20 220/254.1
2015/0053725 A1 * 2/2015 Hingorani ..... B65D 47/088 222/484
2018/0105332 A1 * 4/2018 Ohkubo ..... B65D 75/5883
2018/0111727 A1 * 4/2018 Showering ..... B65D 51/1677
2018/0170626 A1 * 6/2018 Kwon ..... B65D 41/3404
2019/0144189 A1 * 5/2019 Van Der Molen ..... B65D 75/5883 383/80
2020/0399036 A1 * 12/2020 Dai ..... B65D 41/325
2021/0122532 A1 * 4/2021 Dreyer ..... B65D 41/3447
2022/0081171 A1 * 3/2022 Erwin ..... B65D 41/3428
2022/0106081 A1 * 4/2022 Falzoni ..... B65D 41/3428
2022/0153483 A1 * 5/2022 Lässer ..... B65D 41/3428
2022/0234791 A1 * 7/2022 Koenigseder ..... B65D 47/0833
2022/0267052 A1 * 8/2022 Dreyer ..... B65D 41/3447
2022/0297896 A1 * 9/2022 Zuffa ..... B29C 43/361
2022/0371772 A1 * 11/2022 Wassum ..... B65D 5/747
2022/0396400 A1 * 12/2022 Graux ..... B65D 55/16
2023/0025075 A1 * 1/2023 Leuenberger ..... B65D 55/16

(56) References Cited

U.S. PATENT DOCUMENTS

2023/0087314 A1* 3/2023 Gosling ..... B65D 41/3423 215/252
2023/0089722 A1* 3/2023 van den Hoonaard ..... B65D 41/3409 215/252
2023/0098984 A1* 3/2023 Nakamura ..... B29D 99/0096 215/252
2023/0257169 A1* 8/2023 Lohrman ..... B65D 41/3428 215/252
2023/0264873 A1* 8/2023 Kainz ..... B65D 41/3428 215/306
2023/0322465 A1* 10/2023 Buzzi ..... B65D 41/34 206/457
2023/0365318 A1* 11/2023 Zammori ..... B65D 47/06
2024/0034519 A1* 2/2024 Dubach ..... B65D 5/748
2024/0101324 A1* 3/2024 Gosling ..... B65D 55/16
2024/0150092 A1* 5/2024 Krautkrämer ..... B65D 51/222
2024/0190622 A1* 6/2024 Graux ..... B65D 41/485
2024/0262574 A1* 8/2024 Laesser ..... B65D 47/122
2024/0327073 A1* 10/2024 Bhagat ..... B65D 55/16
2024/0425222 A1* 12/2024 Zammori ..... B65D 1/0246
2025/0033842 A1* 1/2025 Buzzi ..... B65D 41/36
2025/0187803 A1* 6/2025 Scheibenstock ..... B65D 55/16

FOREIGN PATENT DOCUMENTS

KR 20110036736 A 4/2011
KR 20130017736 A 2/2013
KR 1957747 B1 3/2019

OTHER PUBLICATIONS

PCT Written Opinion for International Application No. PCT/KR2022/016277, mailed Jul. 12, 2023, 5pp.

* cited by examiner

CONTAINER LID HAVING OPENING IDENTIFICATION FUNCTION

CROSS REFERENCE TO RELATED APPLICATIONS

This application is a National Phase of PCT Patent Application No. PCT/KR2022/016277 having International filing date of Oct. 24, 2022, the contents of which are incorporated herein by reference in their entirety.

TECHNICAL FIELD

The present invention relates to a container lid having an opening identification function, and more specifically, to a container lid having an opening identification function, which may easily identify initial opening of a container.

BACKGROUND ART

In general, a structure having an opening check function is applied to a bottle containing contents such as medicine or health supplements such that consumers may not be deceived through an illegal method by allowing the consumers to directly and visually identify opening of the container lid without permission.

An opening check structure that is generally known in the related art is divided through a perforation line between a cap and a support, and has an opening check ring with a handle for perforation at one end thereof in an appropriate range around the lid.

In an area where the opening check ring is not formed, only the perforation line is placed so that the opening check ring is cut during lifting-up of the cap after cutting the opening check ring.

Alternatively, in the area where the opening check ring is not formed, a plurality of fine cut pieces are formed at regular intervals, and an opening state may be checked as the opening check ring is torn during the lifting-up of the cap after cutting the opening check ring.

However, since the above structures have to cut the opening check ring for opening and the cut opening check ring has to be immediately discarded as garbage, there is a problem such as plastic environmental pollution due to waste of resources and processing.

In addition, the container lid is generally manufactured by injecting a synthetic resin, and since the opening check ring protrudes, there is a problem in that manufacturing is difficult, resulting in deterioration of productivity.

In order to solve these problems, a container that may check initial opening has been developed and released.

However, the container is difficult to be manufactured due to its complicated structure, and there is a limit to easily recognize the opening.

DISCLOSURE

Technical Problem

To solve the above-described problems, an object of the present invention is to provide a container lid having an opening identification function, which may be easily manufactured using a relatively simple structure and may recognize initial opening of the container lid by a user.

Technical Solution

To achieve the above object, a container lid having an opening identification function of the present invention includes: a base member formed in a hollow shape and coupled to a container body having an open upper portion along an upper circumference of the container body; a cover member configured to open or close an upper portion of the base member; a hinge member configured to connect a rear side of the base member and a rear side of the cover member to each other to allow the cover member to rotate up and down with respect to the base member so as to open or close the upper portion of the container body; a handle portion protruding from a front side of the cover member; and a fracture member configured to connect the upper portion of the base member and a lower portion of the cover member, which face each other, before the cover member is opened with respect to the base member, in which the upper portion of the base member has an avoidance groove formed concavely downward, the fracture member is disposed in the avoidance groove, the fracture member includes: a first support portion having one end connected to a bottom surface of the avoidance groove; a second support portion having one end connected to the lower portion of the cover member; and a connection portion configured to connect the other end of the first support portion and the other end of the second support portion to each other, the one end of the first support portion and the one end of the second support portion are disposed adjacent to each other in a direction in which the handle portion is formed, the connection portion is disposed in a direction opposite to the direction in which the handle portion is formed on a basis of the first support portion and the second support portion, so that the connection portion is disposed at a position farthest from the handle portion in the fracture member, and when the cover member is opened by initially rotating up with respect to the base member by an external force, the fracture member is plastically deformed while being deployed and extended up and down, and is cut.

A total length of the fracture member that is cut after being extended by the external force may be increased compared to a total length of the fracture member before being extended.

When the cover member is opened by initially rotating up with respect to the base member by the external force, the one end of the second support portion may be lifted-up together with the cover member, and the connection portion that is disposed at a position farthest from the handle portion may move in one direction in which the one end of the support portion and the one end of the second support portion are disposed due to lifting-up of the second support portion, as the connection portion moves in the one direction, the fracture member may be plastically deformed while being extended up and down, and is cut, and the fracture member that is cut may be plastically deformed up and down compared to a shape of the fracture member before the external force is applied, so that the fracture member may be exposed to an outside of the avoidance groove when the cover member is closed again.

The first support portion may be inclined upward from the one end to the other end thereof, the second support portion may be inclined downward from the one end to the other end thereof, and the other end of the first support portion and the other end of the second support portion, which are inclined, may be connected to each other by the connection portion while being close to each other.

The connection portion that connects the other end of the first support portion and the other end of the second support portion to each other may be formed in a "C" shape, the first support portion, which is disposed under the connection portion, and the second support portion, which is disposed on the connection portion, may be spaced apart from each other.

The connection portion may be cut when the fracture member is extended by the external force, and the one end of the first support portion and the one end of the second support portion may be vertically disposed on the same vertical line.

The one end of the first support portion and the one end of the second support portion may be disposed below the handle portion.

Advantageous Effects

According to the container lid having an opening identification function of the present invention as described above, the following effects are obtained.

The present invention is cut as the fracture member is deformed upon the initial opening of the cover member, and thus the user may easily recognize the initial opening of the cover member by looking at the deformed fracture member.

In addition, when the cover member is closed again as the length of the fracture member is deformed or increased, the cut first and second support portions of the fracture member are exposed to the outside of the avoidance groove, so that the user may easily recognize the initial opening of the cover member.

MODE FOR INVENTION

First Embodiment

Figure 1:
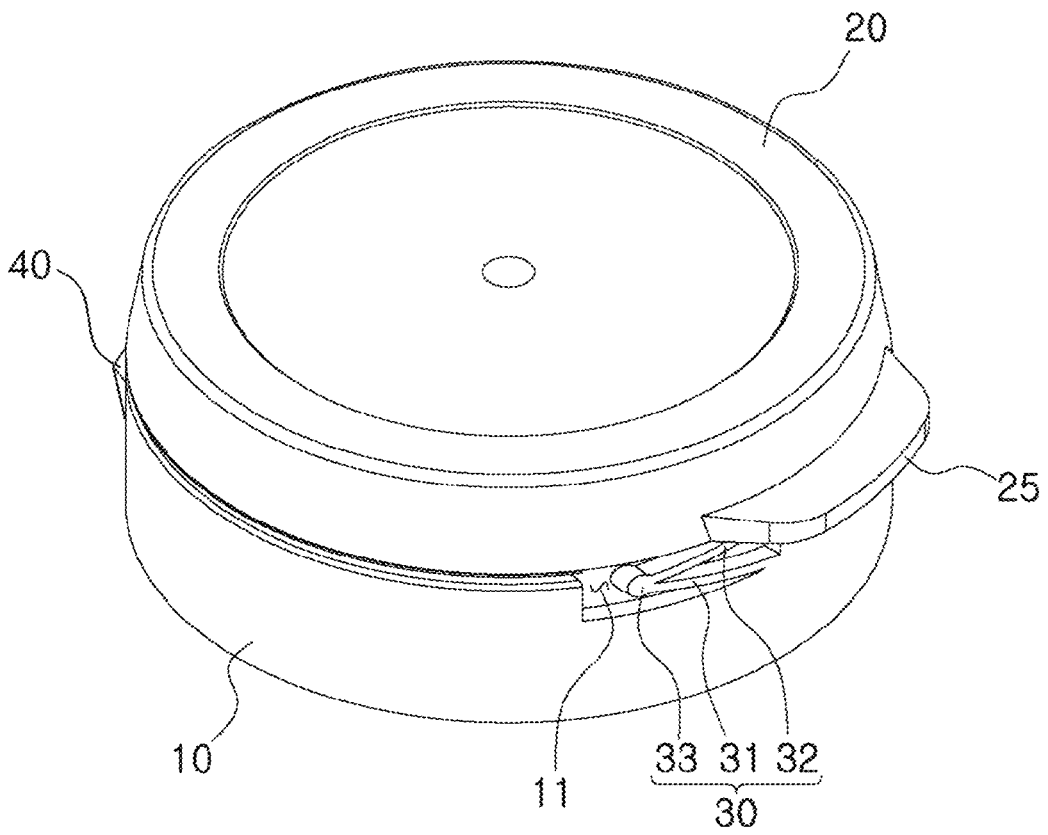
FIG. 1 is a perspective view of a container lid according to a first embodiment of the present invention.
Figure 2:
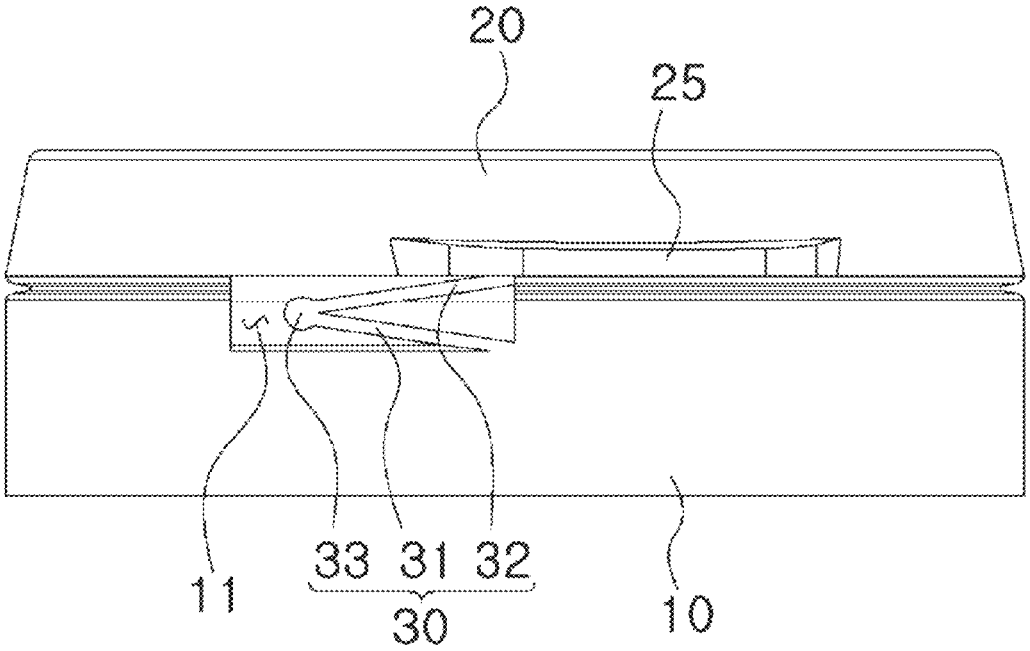
FIG. 2 is a front view of a fracture member of the container lid according to the first embodiment of the present invention.
Figure 3:
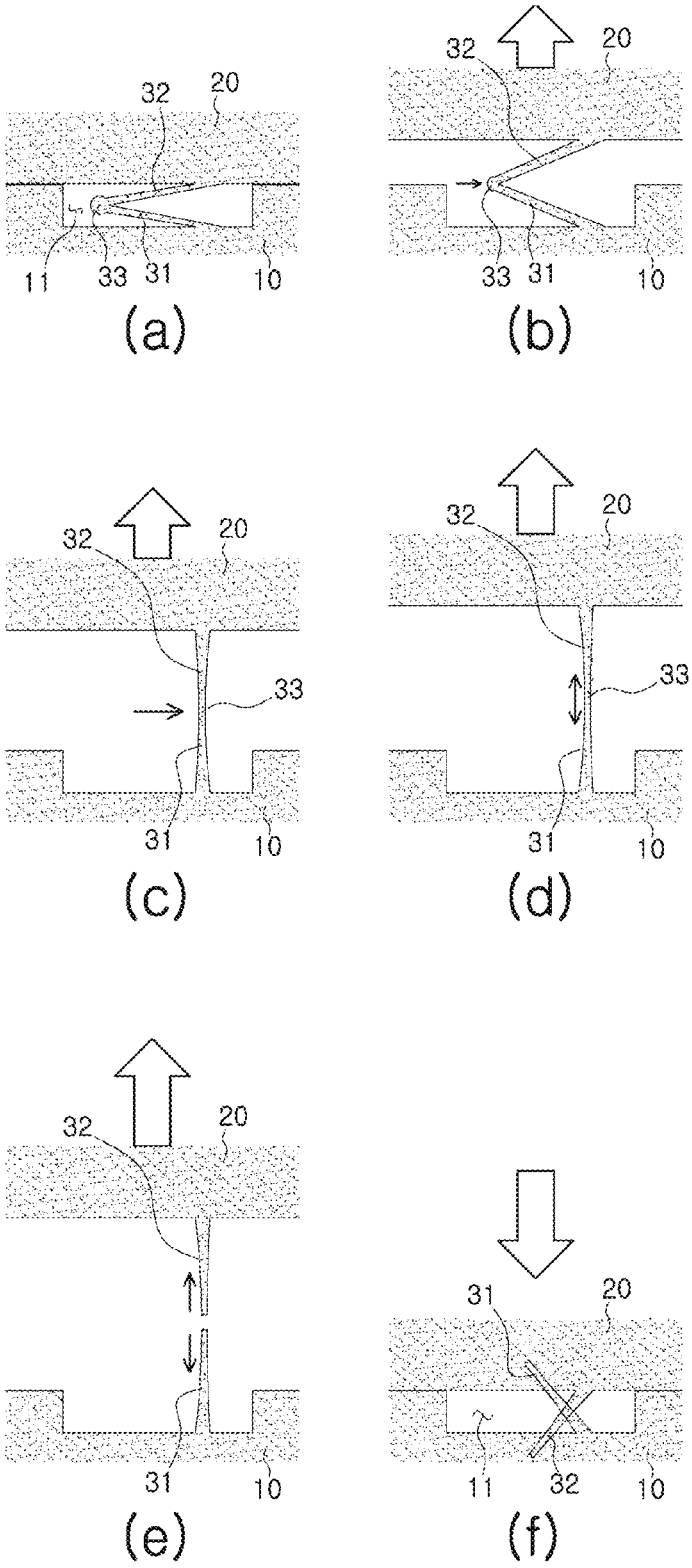
FIG. 3 is a view showing a process of states of the fracture member in each process when the container lid is opened according to the first embodiment of the present invention.

FIG. 1 is a perspective view of a container lid according to a first embodiment of the present invention, FIG. 2 is a front view of a fracture member of the container lid according to the first embodiment of the present invention, and FIG. 3 is a view showing a process of states of the fracture member in each process when the container lid is opened according to the first embodiment of the present invention.

As shown in FIGS. 1 and 2, the container lid having an opening identification function of the present invention includes a base member 10, a cover member 20, a hinge member (not shown), a handle portion 25, and a fracture member 30.

The container lid of the present invention is coupled to an upper portion of a container body (not shown) constituting a medicine container, a gum container, and the like to open or close the upper portion thereof.

The base member 10 is formed in a hollow shape and coupled to the container body having an upper portion around an upper circumference of the container body.

The cover member 20 is disposed on the base member 10 to open or close the base member 10.

The hinge member (not shown) connects a rear side of the base member 10 and a rear side of the cover member 20 to each other to allow the cover member 20 to rotate up and down with respect to the base member 10 so as to open or close the upper portion of the container body.

The handle portion 24 protrudes from a front side of the cover member 20.

A user may open or close the upper portion of the base member 10 by rotating the cover member 20 up and down while holding the handle portion 25.

The handle portion 25 is formed opposite to the hinge member.

The fracture member 30 connects the upper portion of the base member 10 and a lower portion of the cover member 20, which face each other, before the cover member 20 is initially opened with respect to the base member 10.

The upper portion of the base member 10 has an avoidance groove 11 formed concavely downward, and the fracture member 30 is disposed in the avoidance groove 11.

As described above, by forming the avoidance groove 11 in the upper portion of the base member 10 and disposing the fracture member 30 in the avoidance groove 11, the fracture member 30 may be largely formed, so that the user may more easily recognize cutting of the fracture member 30.

The fracture member 30 includes a first support portion 31, a second support portion 32, and a connection portion 33.

The first support portion 31 has one end connected to a bottom surface of the avoidance groove 11.

The second support portion 32 has one end connected to the lower portion of the cover member 20.

The connection portion 33 connects the other end of the first support portion 31 and the other end of the second support portion 32 to each other.

One end of the first support portion 31 and one end of the second support portion 32 are disposed adjacent to each other in a direction in which the handle portion 25 is formed.

In this case, one end of the first support portion 31 and one end of the second support portion 32 are preferably disposed below the handle portion 25.

As described above, since one end of the first support portion 31 and one end of the second support portion 32 are disposed below the handle portion 25, a vertical displacement of the fracture member 30 that is deployed when the cover member 20 rotates up by the handle portion 25 may be increased.

In addition, one end of the first support portion 31 and one end of the second support portion 32 are preferably disposed vertically on the same vertical line.

The connection portion 33 is disposed in a direction opposite to the direction in which the handle portion 25 is formed on the basis of the first support portion 31 and the second support portion 32.

Therefore, the connection portion 33 is disposed at a position farthest from the handle portion 25 in the fracture member 30.

When the cover member 20 is opened by initially rotating up with respect to the base member 10 by an external force, the fracture member 30 is plastically deformed while being deployed and extended up and down, and is cut.

When the fracture member 30 is extended by an external force, the fracture member 30 may be cut at any one of one end of the first support portion 31, one end of the second support portion 32, and the connection portion 33, and preferably, the fracture member 30 may be cut such that the connection portion 33 connects the first support portion 31 and the second support portion 32 to each other.

To this end, the thickness of the connection portion 33 is made thin, or a cutting line is formed in advance.

The first support portion 31 and the second support portion 32 may have various shapes and structures, and according to the present embodiment, the first support portion 31 is inclined upward from one end to the other end thereof, and the second support portion 32 is inclined downward from one end to the other end thereof.

In addition, the other end of the first support portion 31 and the other end of the second support portion 32, which are inclined, are connected to each other by the connection portion 33 while being close to each other.

Therefore, according to the present embodiment, the fracture member 30 is formed in a "left angle bracket (<)" shape or a "right angle bracket (>)" shape.

FIG. 3 shows a process of deforming the shape of the fracture member 30 due to a vertical movement of the cover member 20.

FIG. 3(*a*) shows a state where initial opening is not performed.

When the external force is applied in the state shown in FIG. 3(*a*), the cover member 20 is opened by initially rotating up with respect to the base member 10.

Initially, as shown in FIG. 3(*b*), one end of the second support portion 32 is lifted-up together with the cover member 20, and thus the connection portion 33, which is disposed at a position farthest from the handle portion 25, moves in one direction in which one end of the first support portion 31 and one end of the second support portion 32 are disposed, that is, in a right direction in FIG. 3(*b*) due to the lifting-up of the second support portion 32.

As described above, when the fracture member 30 is deployed up and down and further lifted-up as the connection portion 33 moves in one direction as shown in FIG. 3(*c*), the fracture member 30 is plastically deformed while being further extended and further lifted-up as shown in FIG. 3(*d*), so that the fracture member 30 is cut as shown in FIG. 3(*e*).

The cut fracture member 30 is plastically deformed up and down compared to the shape of the fracture member before the external force is applied, so that the fracture member 30 is exposed to the outside of the avoidance groove 11 when the cover member 20 is closed again as shown in FIG. 3(*f*).

In particular, the first support portion 31 and the second support portion 32, which are inclined, are extended up and down by the cover member 20, the first support portion 31 and the second support portion 32 are plastically deformed in a direction with a larger inclination angle, and the cut fracture member 30 is deformed such that a vertical length thereof is increased.

Accordingly, the vertical length of the cut fracture member 30 is increased compared to the vertical length of the fracture member 30 before the fracture member 30 is cut, so that when the cover member 20 is closed again, the first support portion 31 and the second support portion 32 are exposed to the outside of the avoidance groove 11 as shown in FIG. 3(*f*).

In particular, when the cover member 20 is initially opened, since the first support portion 31 and the second support portion 32 are plastically deformed while being extended by the external force, the first support portion 31 and the second support portion 32 have lengths longer than the length before the first support portion 31 and the second support portion 32 are cut, and thus, when the cover member 20 is closed again, the lengths of the cut first support portion 31 and the second support portion 32 exposed to the outside of the avoidance groove 11 are increased.

Since the first support portion 31 and the second support portion 32 are exposed to the outside of the avoidance groove 11 as described above, the user may easily recognize that the fracture member 30 has been cut, and thus can easily recognize that the cover member 20 has already been opened.

In addition, the total length of the fracture member 30 that is cut after being extended by the external force is preferably increased compared to the total length of the fracture member 30 before being extended.

As described above, since the length of the fracture member 30 is increased as the fracture member 30 is plastically deformed, the lengths of the first support portion 31 and the second support portion 32, which are exposed to the outside of the avoidance groove 11 when the fracture member 30 is cut, are increased as described above, so that the user may more easily recognize that the fracture member 30 is cut.

According to the present invention, since the fracture member 30 is cut while being deformed upon initial opening of the cover member 20, the initial opening of the cover member 20 may be easily recognized, and when the cover member 20 is closed again as the length of the fracture member 30 is deformed or increased, the cut first support portion 31 and the cut second support portion 32 of the fracture member 30 are exposed to the outside of the avoidance groove 11, so that the user may easily recognize the initial opening of the cover member 20.

Second Embodiment

Figure 4:
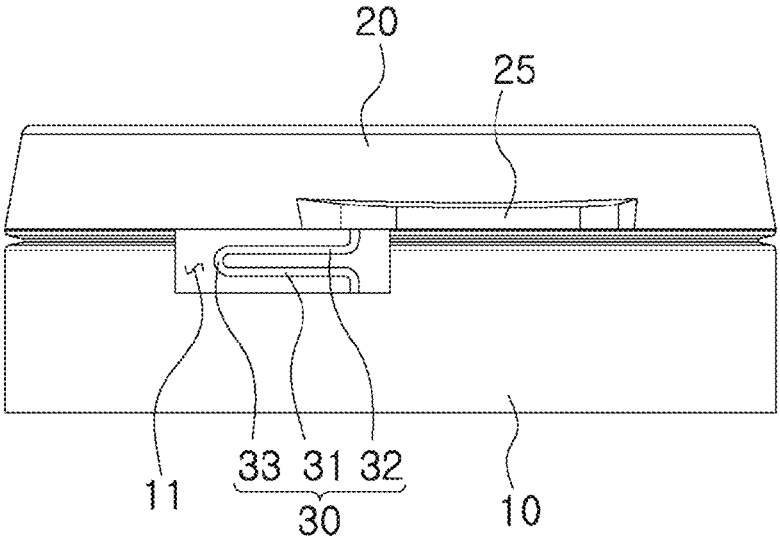
FIG. 4 is a front view of a fracture member of a container lid according to a second embodiment of the present invention.

FIG. 4 is a front view of a fracture member of a container lid according to a second embodiment of the present invention.

Compared to the first embodiment, the second embodiment has a difference in the shape of the fracture member 30, which will be mainly described.

The fracture member 30 includes a first support portion 31, a second support portion 32, and a connection portion 33.

The connection portion 33 connects the other end of the first support portion 31 and the other end of the second support portion 32 to each other.

According to the present embodiment, the first support portion 31 protrudes upward from a bottom surface of the avoidance groove 11, and the other end thereof is horizontally bent.

In addition, the second support portion 32 protrudes downward from a bottom surface of the cover member 20, and the other end thereof is horizontally bent in the same manner as in the first support portion 31.

The connection portion 33 is formed in a "C" shape to connect the other end of the first support portion 31 and the other end of the second support portion 32 to each other, which are horizontally disposed in parallel.

Due to this structure, the first support portion 31 disposed under the connection portion 33 and the second support portion 32 disposed on the connection portion 33 are spaced apart from each other.

According to the present embodiment, since the first support portion 31 and the second support portion 32 are horizontally formed in parallel and the connection portion 33 is formed in a "C" shape, the user may more easily recognize cutting of the fracture member 30 upon cutting of the connection portion 33.

Since other matters are the same as or similar to those of the first embodiment, a detailed description thereof will be omitted.

The container lid having an opening identification function of the present invention is not limited to the above-described embodiments, and may be variously modified and implemented within a range in which the technical spirit of the present invention is allowed.

INDUSTRIAL APPLICABILITY

The present invention may be applied to a container lid so that industrial applicability is obtained.

The invention claimed is:

1. A container lid having an opening identification function, the container lid comprising:

a base member formed in a hollow shape and coupled to a container body having an open upper portion along an upper circumference of the container body;

a cover member configured to open or close an upper portion of the base member;

a hinge member configured to connect a rear side of the base member and a rear side of the cover member to each other to allow the cover member to rotate up and down with respect to the base member so as to open or close the upper portion of the container body;

a handle portion protruding from a front side of the cover member; and a fracture member configured to connect the upper portion of the base member and a lower portion of the cover member, which face each other, before the cover member is opened with respect to the base member, wherein the upper portion of the base member has an avoidance groove formed concavely downward, the fracture member is disposed in the avoidance groove, the fracture member includes:

a first support portion having one end connected to a bottom surface of the avoidance groove;

a second support portion having one end connected to the lower portion of the cover member; and a connection portion configured to connect the other end of the first support portion and the other end of the second support portion to each other, the one end of the first support portion and the one end of the second support portion are disposed adjacent to each other in a direction in which the handle portion is formed, the connection portion is disposed in a direction opposite to the direction in which the handle portion is formed on a basis of to the first support portion and the second support portion, so that the connection portion is disposed at a position farthest from the handle portion in the fracture member, and when the cover member is opened by initially rotating up with respect to the base member by an external force, the one end of the second support portion is lifted-up together with the cover member, and the connection portion that is disposed at a position farthest from the handle portion moves in one direction in which the one end of the first support portion and the one end of the second support portion are disposed due to lifting-up of the second support portion, as the connection portion moves in the one direction, the fracture member is plastically deformed while being extended up and down, and is cut, and the fracture member that is cut is plastically deformed up and down compared to a shape of the fracture member before the external force is applied, so that the fracture member is exposed to an outside of the avoidance groove when the cover member is closed again, wherein the connection portion is formed in a "C" shape, and the first support portion, which is disposed under the connection portion, and the second support portion, which is disposed on the connection portion, are spaced apart from each other.

2. The container lid of claim 1, wherein a total length of the fracture member that is cut after being extended by the external force is increased compared to a total length of the fracture member before being extended.

3. The container lid of claim 1, wherein the first support portion is inclined upward from the one end to the other end thereof, the second support portion is inclined downward from the one end to the other end thereof, and the other end of the first support portion and the other end of the second support portion, which are inclined, are connected to each other by the connection portion while being close to each other.

4. The container lid of claim 1, wherein the connection portion is cut when the fracture member is extended by the external force.

5. The container lid of claim 1, wherein the one end of the first support portion and the one end of the second support portion are vertically disposed on the same vertical line.

6. The container lid of claim 1, wherein the one end of the first support portion and the one end of the second support portion are disposed below the handle portion.

* * * * *